US012116854B2

(12) United States Patent
Andersen

(10) Patent No.: US 12,116,854 B2
(45) Date of Patent: Oct. 15, 2024

(54) DOWNHOLE SELF-PROPELLING WIRELINE TOOL

(71) Applicant: WELLTEC A/S, Allerød (DK)

(72) Inventor: Tomas Sune Andersen, Allerød (DK)

(73) Assignee: WELLTEC A/S, Allerød (DK)

( * ) Notice: Subject to any disclaimer, the term of this patent is extended or adjusted under 35 U.S.C. 154(b) by 5 days.

(21) Appl. No.: 17/962,907

(22) Filed: Oct. 10, 2022

(65) Prior Publication Data

US 2023/0112756 A1 Apr. 13, 2023

(30) Foreign Application Priority Data

Oct. 11, 2021 (EP) ..... 21202035
Nov. 29, 2021 (EP) ..... 21211103

(51) Int. Cl.
*E21B 23/14* (2006.01)
*E21B 34/06* (2006.01)
*E21B 47/06* (2012.01)

(52) U.S. Cl.
CPC ..... *E21B 23/14* (2013.01); *E21B 34/06* (2013.01); *E21B 47/06* (2013.01)

(58) Field of Classification Search
CPC ..... E21B 23/14; E21B 34/06; E21B 47/06
USPC ..... 166/65.1
See application file for complete search history.

(56) References Cited

U.S. PATENT DOCUMENTS

2015/0167416 A1* 6/2015 Ludwig ..... E21B 4/006 166/385
2019/0277125 A1* 9/2019 Coli ..... F04B 17/03
2020/0200194 A1* 6/2020 McInally ..... F15B 11/161
2021/0198994 A1* 7/2021 Christinzio ..... B01F 33/805
2022/0243560 A1* 8/2022 Al-Huwaider ..... E21B 37/02
2022/0281325 A1* 9/2022 Naito ..... B60L 58/14
2022/0316481 A1* 10/2022 Hiramoto ..... F04D 15/0066

FOREIGN PATENT DOCUMENTS

| | | |
|---|---|---|
| EP | 2 505 772 | 10/2012 |
| EP | 2 696 026 | 2/2014 |
| WO | 2017/142415 | 8/2017 |
| WO | 2019/004834 | 1/2019 |

OTHER PUBLICATIONS

Extended European Search Report for EP21202035.8 dated Mar. 4, 2022, 8 pages.

* cited by examiner

*Primary Examiner* — Taras P Bemko
(74) *Attorney, Agent, or Firm* — Nixon & Vanderhye P.C.

(57) ABSTRACT

A downhole driving unit for propelling a tool forward in a well and/or for providing weight on a bit while performing an operation, includes a tool body, an electric motor powered by a wireline, a plurality of projectable arm assemblies connected in a first arm end with the tool body, a plurality of wheels for contacting a wall of the well, each wheel comprising a hydraulic motor for rotation of the wheel, each arm assembly being at a second arm end connected with one of the plurality of wheels, and a first hydraulic pump driven by the electric motor for generation of a first fluid pressure for projection of the plurality of projectable arm assemblies. The downhole driving unit further comprises a hydraulic section with a first controllable valve controlling the first fluid pressure.

15 Claims, 6 Drawing Sheets

DOWNHOLE SELF-PROPELLING WIRELINE TOOL

Figure 1:
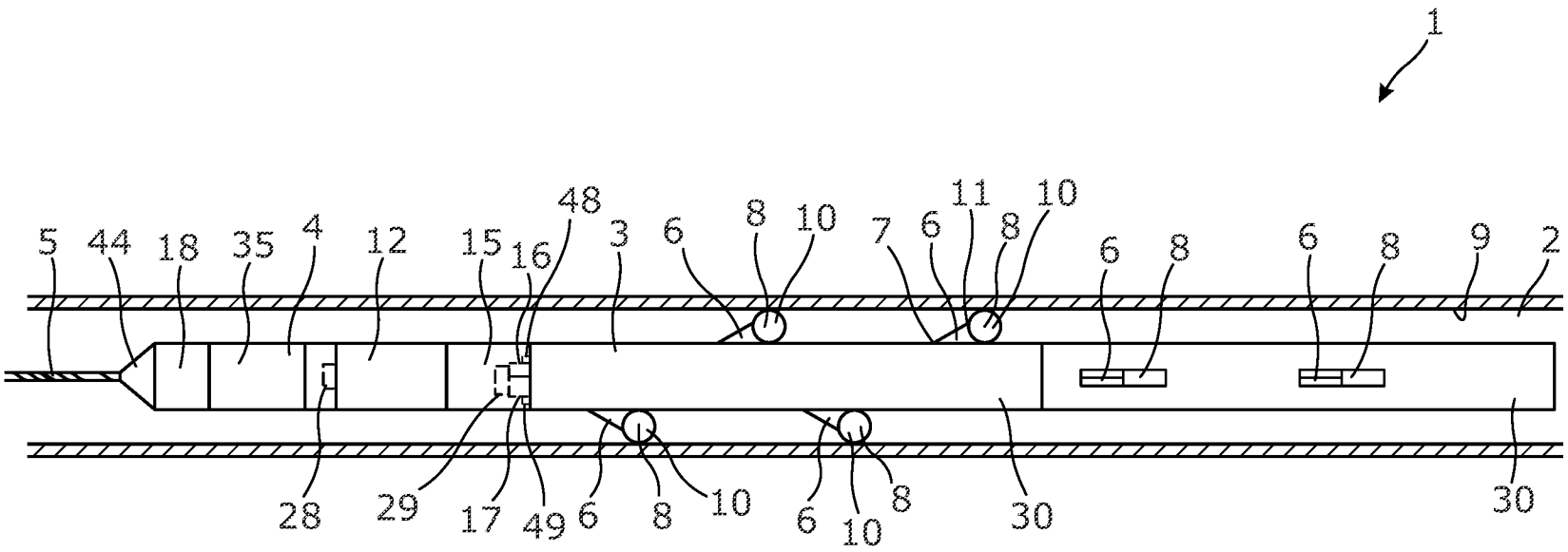

This application claims priority to EP 21211103.3 filed Nov. 29, 2021 and EP 21202035.8 filed Oct. 11, 2021, the entire contents of each of which are hereby incorporated by reference.

The present invention relates to a downhole self-propelling wireline tool for propelling a tool forward in a well and/or for providing weight on a bit while performing an operation. The present invention also relates to a downhole system.

Downhole intervention operations such as cleaning, milling, logging and sliding sleeves are often performed by means of a self-propelling driving unit propelling the operational tool forward in the well. When logging, the speed of the driving unit needs to be very constant over several kilometres, and in other operations the weight on bit (WOB) during a milling operation several kilometres down the well needs to be constant. While propelling the tool forward in the well, the driving unit also needs to pull the wireline with it, and as the tool is driven further and further down the well the power for pulling the wireline increases. Thus, in existing driving units the speed in the last part of the well is calculated based on the power available in the last part of the well for pulling the wireline and for keeping a certain speed, and the driving unit is adjusted at surface to drive at the calculated speed, even though more power is available in the first part of the well where less power is needed for pulling the wireline as the wireline is shorter. The driving unit, therefore, does not use all power available in the first part of the well since the driving unit can only be adjusted at surface to drive at one predetermined speed. In some more developed driving units, the driving unit has a first driving section and a second driving section, and when driving in the first part of the well the second driving section is turned off so that all power is distributed to the first driving section, and in this way the driving unit is capable of driving at a higher speed than when both driving sections are activated. Such driving units have to drive at two different speeds.

It is an object of the present invention to wholly or partly overcome the above disadvantages and drawbacks of the prior art. More specifically, it is an object to provide an improved downhole self-propelling wireline tool being able to drive at more varying speed than in the known solutions.

The above objects, together with numerous other objects, advantages and features, which will become evident from the below description, are accomplished by a solution in accordance with the present invention by a downhole self-propelling wireline tool for propelling a tool forward in a well and/or for providing weight on a bit while performing an operation, comprising:

- a tool body,
- an electric motor operating at a rotational speed and powered by a wireline,
- a plurality of projectable arm assemblies movably connected at a first arm end with the tool body and projectable from the tool body by means of a first fluid having a first fluid pressure,
- a plurality of wheels for contacting a wall of the well, each wheel comprising a hydraulic motor for rotation of the wheel to provide a self-propelling movement, each wheel being connected with a second arm end of one of the arm assemblies,

- a first hydraulic pump driven by the electric motor for generation of a second fluid pressure of a second fluid for driving the hydraulic motor(s) rotating the wheel(s), and
- a first pressure sensor measuring the second fluid pressure, such as continuously measuring the second fluid pressure, wherein the downhole self-propelling wireline tool further comprises a hydraulic section comprising a first controllable valve controlling the first fluid pressure based on the second fluid pressure.

By having a first controllable valve controlling the first fluid pressure based on the second fluid pressure, the wheels are not pressed more outwards than needed. The higher the second fluid pressure, the higher the first pressure needs to be. When having a low second fluid pressure, the first pressure is adjusted to match the low second fluid pressure so that power is not wasted on providing a first fluid pressure higher than needed. Furthermore, if the first fluid pressure is higher than the optimal first fluid pressure matching the present second fluid pressure, then too much friction is applied to the wall of the well, compromising the maximum available velocity of the downhole driving unit.

In one aspect, the first pressure sensor may continuously measure the second fluid pressure.

Data representing the measured second fluid pressure may be communicated to the electric control unit.

The electric control unit may electrically control the first controllable valve by conducting electric power to the valve for moving the valve to a more or less open position. In this way, the first controllable valve controls the first fluid pressure based on the second fluid pressure.

The sensor and the valve may be seen as a feedback loop where the measurement is fed back to control the valve, and thus an increase or decrease in the second fluid pressure is utilised to provide a resulting action on the valve to increase or decrease the pressure projecting the arms based on the rotational speed of the wheels.

The downhole self-propelling wireline tool may be a hydraulically driven downhole self-propelling wireline tool such as a downhole wireline tractor.

Furthermore, the first hydraulic pump may generate the first fluid pressure for projection of the plurality of projectable arm assemblies.

In addition, the downhole self-propelling wireline tool may further comprise a second hydraulic pump for generating the first fluid pressure for projection of the plurality of projectable arm assemblies.

Also, the hydraulic section may further comprise a second controllable valve controlling the second fluid pressure.

Additionally, the downhole self-propelling wireline tool may further comprise a compensator for providing a predetermined overpressure in the tool.

Moreover, the downhole self-propelling wireline tool may further comprise a surface readout module for sending measured tool parameters, such as the first fluid pressure, the second fluid pressure, the operational rotational speed of the electric motor or the motor output torque, to surface.

In addition, the downhole self-propelling wireline tool may further comprise an electric control unit for controlling the rotational speed of the electric motor.

Further, the electric motor may be a first electric motor.

Also, the electric control unit may comprise a master and/or a motor driver or voltage inverter.

Furthermore, the electric motor may comprise a motor driver measuring an operational rotational speed of the electric motor.

Additionally, the electric control unit may be configured to determine a motor output torque of the electric motor.

Moreover, the electric control unit may be configured to measure the three phases in the electric motor and determine the output torque of the motor by measuring current in the three phases in the electric motor.

In addition, the electric control unit may comprise the motor driver.

Also, the electric control unit may be configured to determine a maximum allowable motor rotational speed based on the motor output torque.

Furthermore, the electric control unit may be configured to compare the operational rotational speed with the maximum allowable motor rotational speed.

Additionally, the electric control unit may be configured to adjust the operational rotational speed of the electric motor based on the comparison in order to adjust the first speed to a second speed if the operational rotational speed is higher than the maximum allowable motor rotational speed.

Moreover, the electric control unit may comprise a capacitor functioning as an energy storage unit or accumulator.

Also, the hydraulic section may further comprise a second pressure sensor.

In addition, the hydraulic section may be configured to measure the first and second fluid pressures by means of the first pressure sensor and the second pressure sensor and to control the valves based on the measured fluid pressures.

Further, the hydraulic section may measure a fluid pressure for rotating the wheels, being the second fluid pressure, a first fluid pressure for projecting the arm assemblies and/or a third fluid pressure in the compensator.

Also, the downhole self-propelling wireline tool may further comprise a second electric motor driving a second hydraulic pump, the first electric motor driving the first hydraulic pump.

Additionally, the second hydraulic pump may generate a third fluid pressure for projection of a second plurality of projectable arm assemblies.

Furthermore, the second hydraulic pump may generate a fourth fluid pressure for driving the hydraulic motor(s) rotating a second plurality of wheels.

Moreover, the second hydraulic pump may generate a third fluid pressure for projection of a second plurality of projectable arm assemblies, the second hydraulic pump generating a fourth fluid pressure for driving the hydraulic motor(s) rotating a second plurality of wheels.

In addition, the hydraulic section may be a first hydraulic section.

Also, the downhole self-propelling wireline tool may further comprise a second hydraulic section comprising a third controllable valve controlling the third fluid pressure and a fourth controllable valve controlling the fourth fluid pressure.

Additionally, the controllable valve(s) may be electronically adjustable/controllable.

Moreover, the controllable valve(s) may be electronically adjustable/controllable from surface.

Furthermore, the controllable valve(s) may be electronically controllable by means of the electric control unit.

Moreover, the first controllable valve and the second controllable valve may be electronically controllable by means of the electric control unit.

Further, the third controllable valve and the fourth controllable valve may be electronically controllable by means of the electric control unit.

In addition, the electric control unit may be arranged in the tool body.

Also, the hydraulic section may be arranged in the tool body.

Moreover, the electric motor(s) may be (a) synchronous motor(s).

Additionally, the electric control unit may further comprise a voltage control unit.

Furthermore, the electric control unit may further comprise an electric current measuring unit.

In addition, the electric control unit may further comprise an electric voltage measuring unit.

Further, the electric control unit may control the controllable valve(s) based on the electric current and/or the electric voltage measured by the electric control unit.

Also, the controllable valve(s) may be (a) controllable pressure relief valve(s).

Moreover, the downhole self-propelling wireline tool may further comprise a machining tool for performing a machining operation and a compression sub comprising a load cell adjacent to the machining tool.

The invention further relates to a tool string comprising two downhole self-propelling wireline tools mounted as one wireline tool string, where each downhole self-propelling wireline tool has a separate electric control unit, a separate electric motor, one or two separate hydraulic pumps, a separate hydraulic section, and one or more separate drive sections.

Furthermore, the tool string may comprise a first downhole self-propelling wireline tool and a second downhole self-propelling wireline tool comprising:

- a tool body,
- a second electric motor operating at a rotational speed and powered by a wireline,
- a plurality of projectable arm assemblies movably connected at a first arm end with the tool body and projectable from the tool body by means of a third fluid having a third fluid pressure,
- a plurality of wheels for contacting a wall of the well, each wheel comprising a hydraulic motor for rotation of the wheel to provide a self-propelling movement, each wheel being connected with a second arm end of one of the arm assemblies,
- at least one second hydraulic pump driven by the second electric motor for generation of a fourth fluid pressure of a fourth fluid for driving the hydraulic motor(s) rotating the wheel(s), and
- a pressure sensor measuring the fourth fluid pressure, such as continuously measuring the fourth fluid pressure, wherein the second downhole self-propelling wireline tool further comprises a second hydraulic section comprising a third controllable valve controlling the third fluid pressure based on the fourth fluid pressure, the first downhole self-propelling wireline tool being in one end connected with the wireline and in another end with the second downhole self-propelling wireline tool.

Finally, the present invention also relates to a downhole system comprising the downhole self-propelling wireline tool, the wireline and a user interface at surface for controlling at least part of the downhole self-propelling wireline tool.

Figure 2:
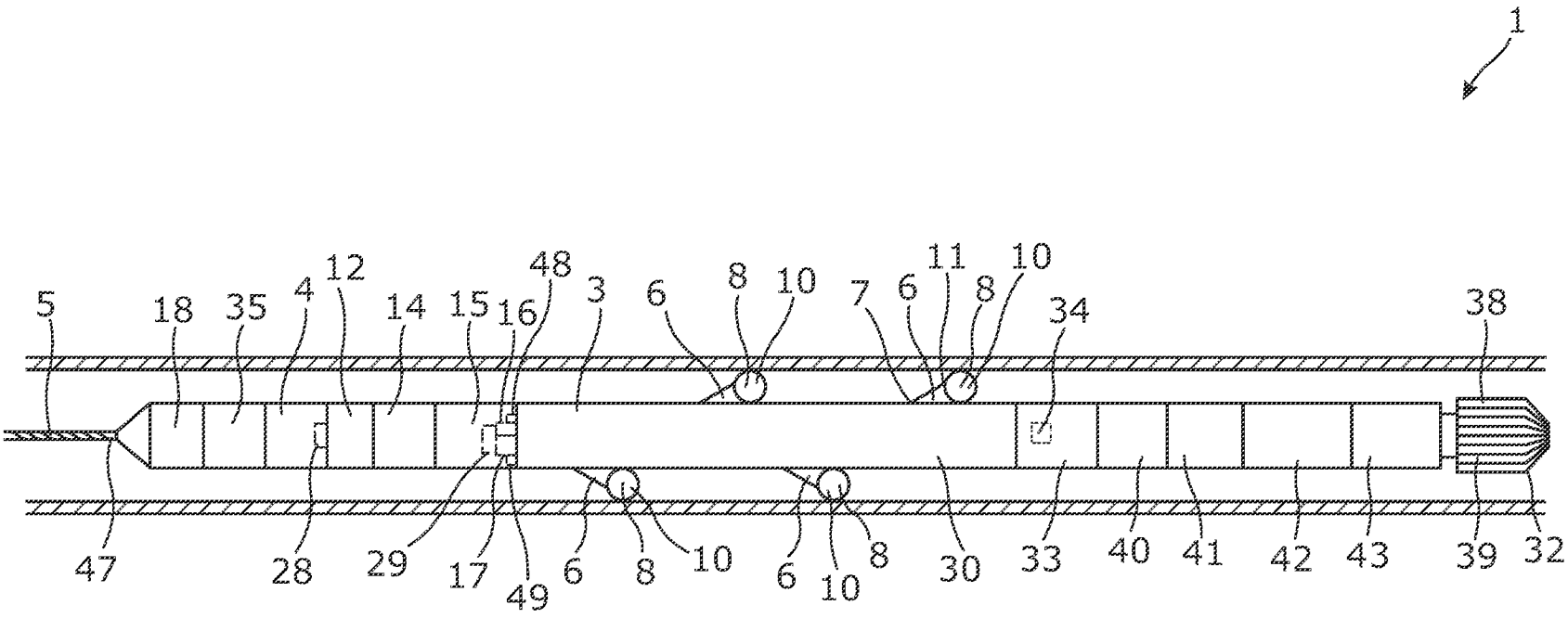
Figure 3:
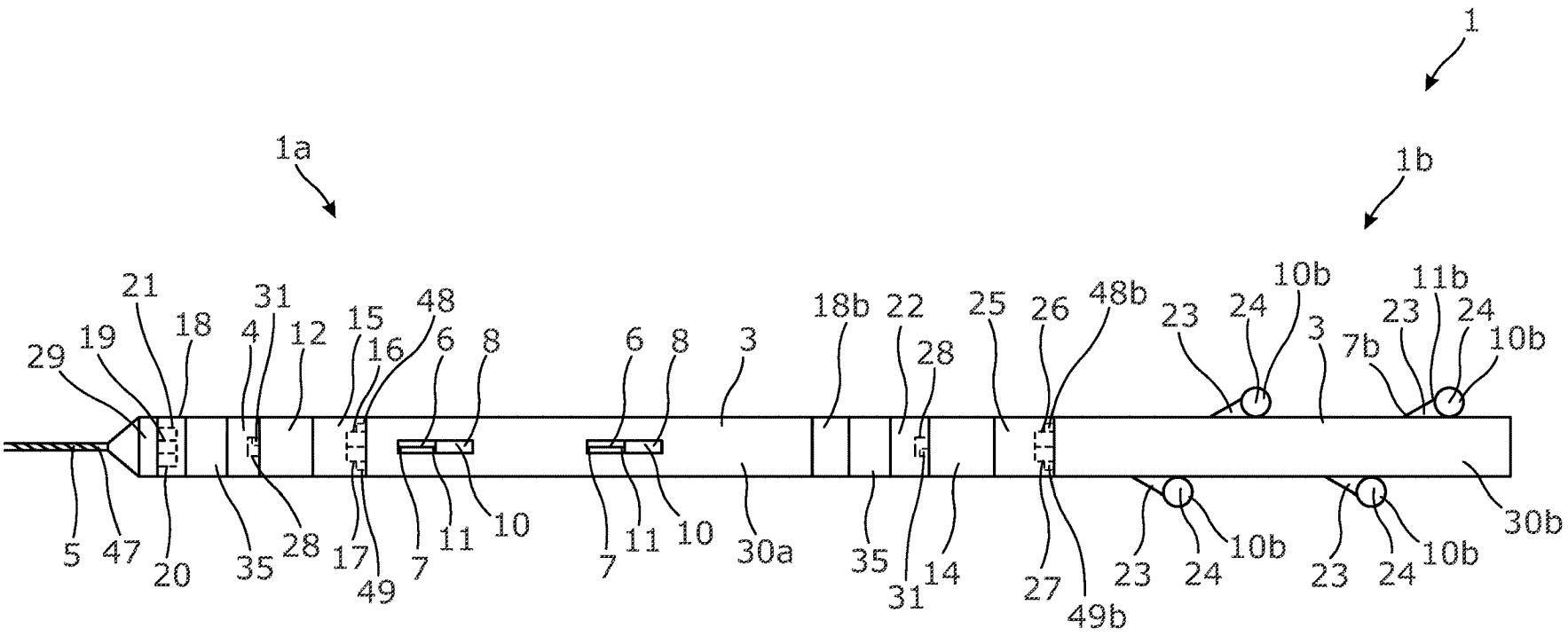
Figure 4:
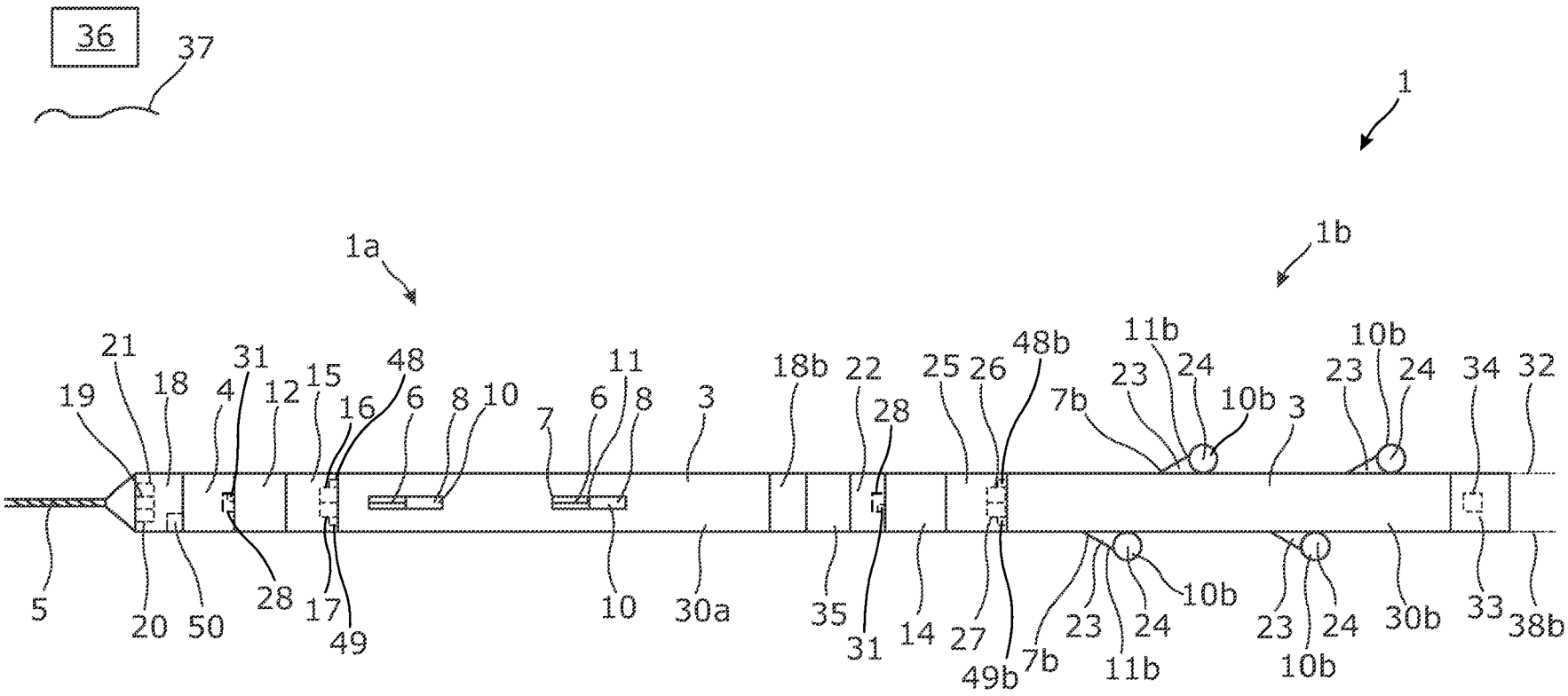
Figure 5:
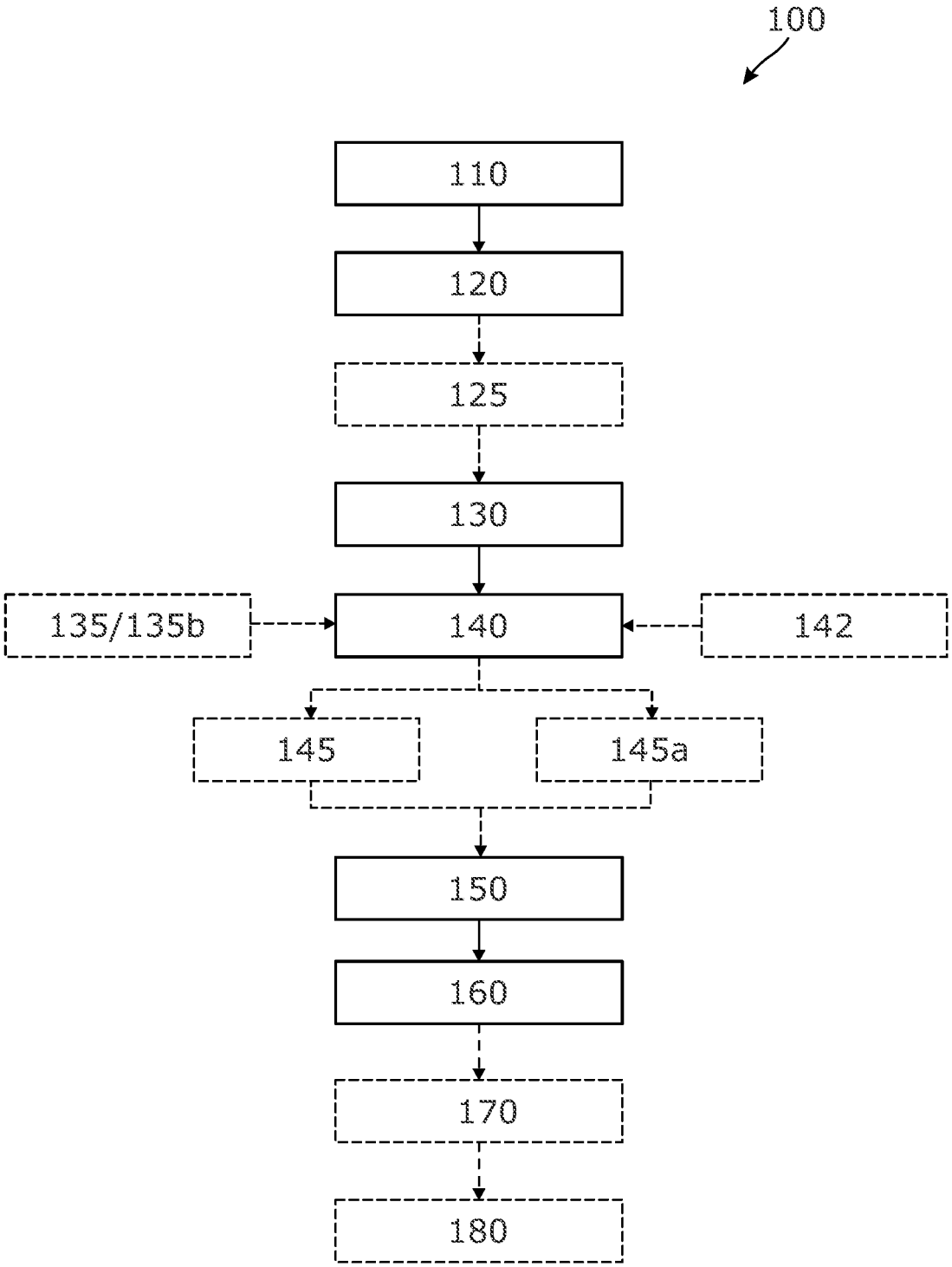
Figure 6:
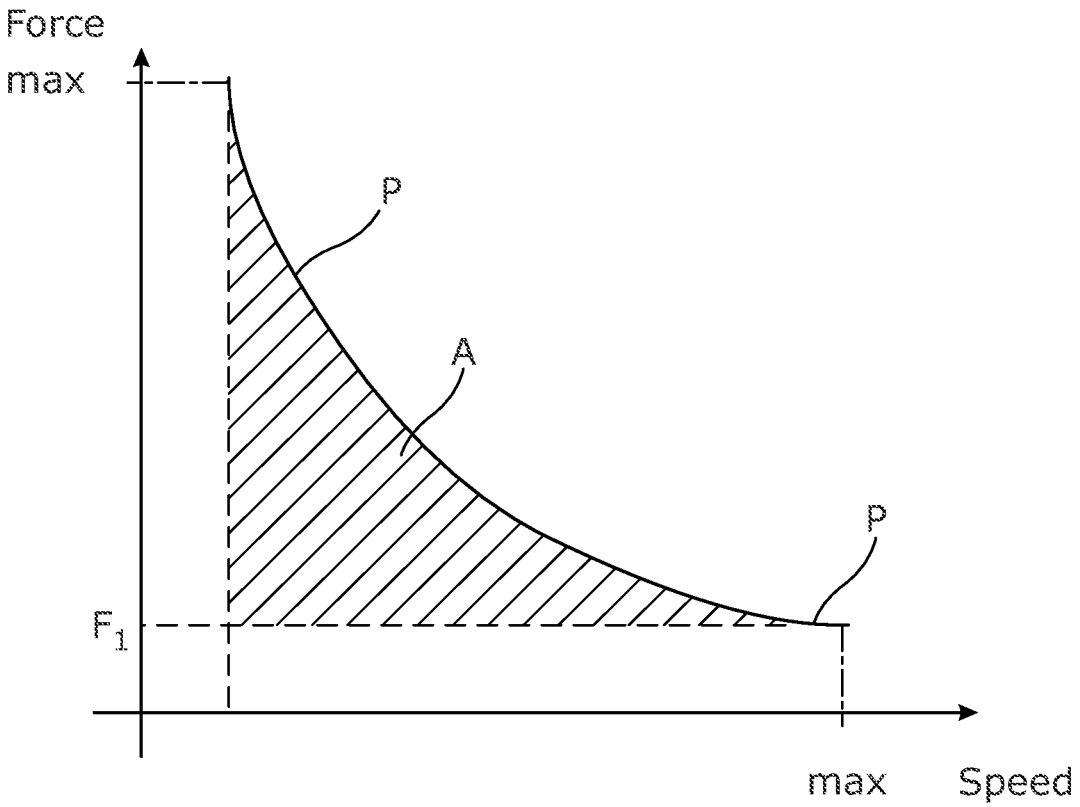

The invention and its many advantages will be described in more detail below with reference to the accompanying schematic drawings, which for the purpose of illustration show some non-limiting embodiments and in which:

FIG. 1 shows a downhole self-propelling wireline tool according to the invention having two wheel sections driven by one electric motor and one hydraulic pump, FIG. 2 shows another downhole self-propelling wireline tool according to the invention having two wheel sections driven by one electric motor and two hydraulic pumps, FIG. 3 shows yet another downhole self-propelling wireline tool according to the invention having two wheel sections, each wheel section being driven by one electric motor and one hydraulic pump, FIG. 4 shows yet another downhole self-propelling wireline tool comprising a compression sub and an operational tool for performing an operation in the well, such as milling with a bit, FIG. 5 shows a downhole self-propelling wireline tool control method with some optional steps, and FIG. 6 shows a graph of the power curve in relation to the pulling force and speed of the tool.

All the figures are highly schematic and not necessarily to scale, and they show only those parts which are necessary in order to elucidate the invention, other parts being omitted or merely suggested.

FIG. 1 shows a downhole self-propelling wireline tool 1 for propelling a tool forward in a well 2 and potentially also for providing weight on a bit 39 while performing an operation, as shown in the tool 1 of FIG. 4. The downhole self-propelling wireline tool 1 comprises a tool body 3 and an electric motor 4 operating at a rotational speed and powered by a wireline 5. The downhole self-propelling wireline tool 1 further comprises a plurality of projectable arm assemblies 6 movably connected at a first arm end 7 with the tool body 3 and projectable from the tool body 3 by means of a first fluid having a first fluid pressure, and a plurality of wheels 8 for contacting a wall 9 of the well, each wheel comprising a hydraulic motor 10 for rotation of the wheel to provide a self-propelling movement, and each wheel being connected with a second arm end 11 of one of the arm assemblies 6, so that the wheel engages the wall when the arm is projected. The electric motor 4 is configured to drive a first hydraulic pump 12 for generation of a second fluid pressure of a second fluid for driving the hydraulic motor(s) 10 rotating the wheel(s) 8. The downhole self-propelling wireline tool 1 is connected to a second end 47 of the wireline 5, a first end of the wireline being connected to a power supply (not shown) at the surface or seabed. The downhole self-propelling wireline tool 1 further comprises a pressure sensor 49 continuously measuring the second fluid pressure and a hydraulic section 15 comprising a first controllable valve 16 controlling the first fluid pressure based on the second fluid pressure.

By having a first controllable valve controlling the first fluid pressure based on the second fluid pressure, the wheels are not pressed more outwards than needed.

The higher the second fluid pressure, the higher the first pressure needs to be in order to propel the downhole self-propelling wireline tool 1 forward in the well in the most optimal manner. When having a low second fluid pressure, the first pressure is adjusted to match the low second fluid pressure so that power is not wasted on providing a first fluid pressure higher than needed. Furthermore, if the first fluid pressure is higher than the optimal first fluid pressure matching the present second fluid pressure, then too much friction is applied to the wall of the well, compromising the maximum available velocity of the downhole driving unit.

The first pressure sensor 49 continuously measures the second fluid pressure, and data representing the measured second fluid pressure is communicated to the electric control unit. When the second fluid pressure changes, the electric control unit electrically controls the first controllable valve by conducting electric power to the valve for moving the valve to a more or less open position, and thus the first controllable valve 16 controls the first fluid pressure based on the second fluid pressure. Thus, the sensor and the valve can be seen as a feedback loop where the measurement is fed back to control the valve, and thus an increase or decrease in the second fluid pressure is utilised to provide a resulting action on the valve to increase or decrease the pressure projecting the arms based on the rotational speed of the wheels.

In FIG. 1, the first hydraulic pump 12 generates the first fluid pressure for projection of the plurality of projectable arm assemblies 6, and in FIG. 2 the downhole self-propelling wireline tool 1 further comprises a second hydraulic pump 14 for generation of the first fluid pressure for projection of the plurality of projectable arm assemblies 6. The downhole self-propelling wireline tool 1 further comprises an electric control unit 18 and a cable head 44 for connecting the tool to the wireline 5.

As shown in FIG. 1, the hydraulic section 15 further comprises a second controllable valve 17 controlling the second fluid pressure. The controllable valve(s) 16, 17 is/are electronically adjustable. The downhole self-propelling wireline tool 1 has two wheel sections 30 where one is rotated 90 degrees around the circumference of the tool in relation to the other in order to centralise the tool in the well. In other operations where centralisation is not important, the downhole self-propelling wireline tool 1 only has one drive section 30, as shown in FIG. 2. Such operation could be a milling or grinding operation in which the downhole self-propelling wireline tool 1 comprises an operational tool as shown in FIG. 2.

The downhole self-propelling wireline tool 1 further comprises a compensator 35 for providing a predetermined overpressure in the tool so that the well fluid does not enter into the tool and jeopardise the function of the tool, and so that the dirty well fluid is not mixed with the hydraulic fluid in the tool.

In FIG. 1, the electric control unit 18 controls the rotational speed of the electric motor 4 and thus also the rotational speed of the pump 12 as well as the tool speed of the downhole self-propelling wireline tool 1 along the longitudinal extension of the well as the pump generates a fluid flow into the wheels 8. At the beginning of the well, closest to the top of the well, the downhole self-propelling wireline tool 1 requires very little force for pulling the wireline 5 along with the tool, but as the downhole self-propelling wireline tool 1 proceeds down the well, the tool 1 requires an increasing amount of force for pulling the wireline 5. As the required force increases, the wheels 8 need higher pressure to rotate, and the pump 12 thus needs more rotational force, i.e. motor output torque, from the electric motor 4. The wirelines used for intervention operations, where such downhole self-propelling wireline tool 1 is used, are rated to a maximum current limit depending on the length of the wireline or other wireline parameters. Thus, it is important that such current limit is not exceeded. Knowing of the voltage either by assumption, calculation or measurement, a power limit P of the operation is also known, and this power limit P is shown in FIG. 6. When the motor output torque increases, the current demand increases correspondingly, and when the current limit is reached, the downhole self-propelling wireline tool 1 needs to reduce its speed, i.e. move along the power limit curve in FIG. 6. This is performed in several ways, where one very simple way is illustrated in FIG. 5.

The adjustment of the operational rotational speed of the electric motor may be performed continuously so as to optimise the pulling force F and speed of the tool to keep the power demand below the power curve P of the graph in area A shown in FIG. 6 in relation to the pulling force and speed of the tool. In this way, all available power is used in the most optimal way to ensure that the downhole self-propelling wireline tool drives at maximum speed while being able to provide the pulling force needed at any location in the well.

In FIG. 5, a method 100 for controlling the downhole self-propelling wireline tool 1 is illustrated. The method comprises running 110 a downhole self-propelling wireline tool 1 into the wellbore 2, supplying 120 electric power to the downhole self-propelling wireline tool to operate the downhole self-propelling wireline tool at a first speed to urge the downhole self-propelling wireline tool through the wellbore at a first force, determining 130 a motor output torque of the motor, and determining 140 a maximum allowable motor rotational speed based on the motor output torque for the purpose of comparing 150 the operational rotational speed with the maximum allowable motor rotational speed. The control method 100 further comprises adjusting 160 the operational rotational speed of the electric motor 4 based on the comparison in order to adjust the first speed to a second speed if the operational rotational speed is higher than the maximum allowable motor rotational speed.

Thereby, a very simple way of adjusting the speed of the hydraulically driven downhole self-propelling wireline tool 1 is provided as only the motor is adjusted to limit the speed, and the more complex hydraulic section merely adjusts the first controllable valve 16 for controlling the first fluid pressure based on the second fluid pressure, thus optimising that sufficient power is provided to project the wheel arms, but not more than needed. The speed of the hydraulically driven downhole self-propelling wireline tool 1 is thus adjusted continuously using all available power, i.e. below the current limit, either for driving at a maximum speed or at the required force and the corresponding maximum allowable speed, and the hydraulically driven downhole self-propelling wireline tool 1 is able to drive at maximum speed until the force to pull the wireline increases to a first force at the power limit curve, above which first force the speed, and thus the rotational speed of the electric motor 4, needs to be reduced so that the current limit is not exceeded. The hydraulically driven downhole self-propelling wireline tool 1 is thus controlled to continuously adjust its speed to a maximum without exceeding the current limit of the wireline 5. By having the first controllable valve 16 controlling the first fluid pressure based on the second fluid pressure, the continuous control of the hydraulically driven downhole self-propelling wireline tool 1 is optimised even further so that no power is wasted on projecting the projectable arm assemblies 6 out towards the wall of the well other than what is needed for optimal friction between the wheels 8 and the wall to drive the hydraulically driven downhole self-propelling wireline tool 1 forward.

In FIG. 6, the maximum speed of the hydraulically driven downhole self-propelling wireline tool 1 is based on the maximum allowed rotational speed of the electric motor 4, and the maximum force is based on the minimum allowed rotational speed of the electric motor. When operating the downhole self-propelling wireline tool at low speed, the maximum force available e.g. for pulling the wireline is very high; however, if such high force is not utilised to its full extent the first pressure at which the projectable arms and thus the wheels are pressed against the inner face of the casing/well tubular metal structure may be unnecessarily high causing unnecessary wear of the wheels. Likewise, when operating the downhole self-propelling wireline tool without using a lot of force, e.g. for pulling in the wireline, then the downhole self-propelling wireline tool may drive at a high speed; however, if the downhole self-propelling wireline tool drives at high speed into an obstruction, the downhole self-propelling wireline tool may shut down or be sufficiently damaged. Therefore, the method may comprise the step of reducing the second fluid pressure and/or the first flid pressure to avoid unnecessary wear of the wheels or avoiding shut down.

The electric control unit 18 comprises a motor driver 28, a master and/or or a voltage inverter. The electric control unit 18 determines 145 or the motor driver 28 determines 145*a* an operational rotational speed of the electric motor 4, and the motor driver 28 is configured to measure 125 current over the three phases to determine 130 a motor output torque of the electric motor 4. The electric control unit 18 or the motor driver 28 is configured to determine 140 a maximum allowable motor rotational speed based on the motor output torque and to compare 150 the operational rotational speed with the maximum allowable motor rotational speed and then adjust 160 the operational rotational speed of the electric motor 4 based on the comparison in order to adjust the first speed to a second speed if the operational rotational speed is higher than the maximum allowable motor rotational speed. Optionally, determining 140 a maximum allowable motor rotational speed based on the motor output torque may also be based on pre-set values 142 for maximum power or maximum current. Furthermore, the electric control unit 18 or the motor driver 28 may measure 135 a current demand of/input to the electric motor and measure 135*b* a voltage input to the electric motor 4, and determining 140 a maximum allowable motor speed based on the motor output torque may thus also be based on a measured current and a measured voltage of the electric motor 4.

By measuring the actual current demand and voltage of the electric motor 4, the maximum allowable motor speed can be determined more precisely as the efficiency of the electric motor 4 varies depending on the operational rotational speed of the electric motor 4. Thus, at a high rotational speed the current demand is lower than at a low rotational speed for the same power output, and the maximum power may therefore be varied to be somewhat larger at high rotational speed than when assuming that the maximum power is constant.

The allowable effect of the electric motor 4 varies with temperature so that at lower temperatures, e.g. below 200° C., the electric motor may run at higher effect than at higher temperatures. The downhole self-propelling wireline tool may therefore comprise a temperature sensor for measuring the temperature of the electric motor and adjusting the allowable effect level of the motor accordingly.

The method as shown in FIG. 5 further comprises controlling 170 the first fluid pressure based on the second fluid pressure by means of the first controllable valve 16 in the hydraulic section 15 of the downhole self-propelling wireline tool 1. The method may optionally further comprise determining 180 the load on the motor based on the torque output.

The downhole self-propelling wireline tool 1 further comprises a surface readout module 29 for sending measured tool parameters, such as the first fluid pressure, the second fluid pressure, the operational rotational speed of the electric motor 4 and/or the motor output torque, to surface.

In FIG. 2, the downhole self-propelling wireline tool 1 comprises an operational tool 38, such as a logging tool 38*b* (shown in FIG. 4) or a machining tool 32, having the bit 39 for performing a machining operation and a compression sub 33 comprising a load cell 34 adjacent to the machining tool 32 in order to measure the actual weight on the bit 39. The operational tool 38 further comprises an electric control unit 40, a compensator 41, an electric motor 42 and a gear section 43 for rotating the bit 39 at another speed than the rotational speed of the motor 42, often at a lower speed. The compression sub 33 comprising the load cell 34 is arranged between the electric control unit 40 and the drive section 30 comprising the wheels 8 on the projectable arm assemblies 6.

In FIG. 3, the electric motor 4 is a first electric motor, and the downhole self-propelling wireline tool 1 comprises a second electric motor 22 driving a second hydraulic pump 14, the first electric motor 4 driving the first hydraulic pump 12. The first electric motor 4 thus drives the first hydraulic pump 12 for generating a first fluid to project the projectable arm assemblies 6 and a second fluid for rotating the wheels 8 of a first drive section 30*a*, and the second electric motor 22 thus drives a second hydraulic pump 14 for generating a third fluid to project the projectable arm assemblies 23 and a fourth fluid for rotating the wheels 24 of a second drive section 30*b*. The plurality of projectable arm assemblies 23 are movably connected at a first arm end 7*b* with the tool body 3, and each wheel 8 comprises a hydraulic motor 10*b* for rotation of the wheel to provide a self-propelling movement, each wheel 8 being connected with a second arm end 11*b* of one of the projectable arm assemblies 23. The second hydraulic pump 14 generates a third fluid pressure of the third fluid for projection of the second plurality of projectable arm assemblies 23. The second hydraulic pump 14 generates a fourth fluid pressure of the fourth fluid for driving the hydraulic motor(s) 10, 10*b* rotating a second plurality of wheels 24. The hydraulic section 15 for the first drive section 30*a* is a first hydraulic section, and the downhole self-propelling wireline tool 1 further comprises a second hydraulic section 25 comprising a third controllable valve 26 controlling the third fluid pressure and a fourth controllable valve 27 controlling the fourth fluid pressure. Both the first controllable valve 16 and the second controllable valve 17 are electronically controllable by means of the electric control unit 18, and the third controllable valve 26 and the fourth controllable valve 27 are electronically controllable by means of a second electric control unit 18*b*. The first electric motor 4 and/or the second electric motor 22 is/are (a) synchronous motor(s).

The tool string of FIG. 3 is thus two downhole self-propelling wireline tools 1*a*, 1*b* mounted as one wireline tool where each has a separate electric control unit, a separate electric motor 4, one or two separate hydraulic pumps, a separate hydraulic section and one or more separate drive sections 30. As shown in FIG. 3, the downhole self-propelling wireline tool string further comprises a surface readout module 29 communicating instructions from surface to each tool and sending measured tool parameters, such as the first fluid pressure, the second fluid pressure, the third fluid pressure, the fourth fluid pressure, the operational rotational speed of the electric motors and/or the motor output torque, to surface.

The first downhole self-propelling wireline tool 1*a* comprises the electric control unit 18, the electric motor 4, one or two hydraulic pumps 12, the hydraulic section 15 and the drive section 30, 30*a* with wheels 8 on projectable arm assemblies 6. The second downhole self-propelling wireline tool 1*b* comprises the electric control unit 18*b*, the electric motor 22, one or two hydraulic pumps 14, the hydraulic section 15 and the drive section 30, 30*b* with wheels 24 on projectable arm assemblies 23. The first downhole self-propelling wireline tool 1*a* is connected to the cable head 44 and the wireline 5. The hydraulic section 15 is configured to measure the first and second fluid pressures by means of the first pressure sensor 49 and a second pressure sensor 48 and to control the valves based on the measured first and second fluid pressures. The second hydraulic section 25 is configured to measure the third and fourth fluid pressures by means of a third pressure sensor 48*b* and a fourth pressure sensor 49*b* and to control the valves based on the measured third and fourth fluid pressures. The controllable valve(s) 16, 17, 26, 27 is/are (a) controllable pressure relief valve(s) and may be controllable from surface. The power to the tool string is thus divided equally between the first and second electric motors 4, 22 so that each motor is limited to half of the current limit to ensure that the tool string does not exceed the allowed current limit on the wireline 5.

The step of running 110 comprises running both the first and second downhole self-propelling wireline tools 1, 1*a*, 1*b* into the wellbore 2, and the step of supplying 120 electric power comprises supplying electric power to both the first and second downhole self-propelling wireline tools 1, 1*a*, 1*b* to operate the first and second downhole self-propelling wireline tools 1, 1*a*, 1*b* at a first speed to urge the tool string through the wellbore 2 at a first force, and the step of determining 130 comprises determining a motor output torque of both the first and second electric motors 4, 22, and the step of determining 140 comprises determining a maximum allowable motor rotational speed based on the motor output torque of both the first and second electric motors, and the step of comparing 150 comprises comparing the operational rotational speed of both the first and second electric motors 4, 22 with the maximum allowable motor rotational speed, and wherein the step of adjusting 160 comprises adjusting the operational rotational speed of both the first and second electric motors 4, 22 based on the comparison in order to adjust the first speed to a second speed if the operational rotational speed is higher than the maximum allowable motor rotational speed.

The electric control unit(s) 18, 18*b* further comprise(s) a voltage control unit 19 having an overvoltage protection unit, so that voltage fed to the tool is kept more constant, and an electric current measuring unit 20. In FIG. 4, the electric control unit 18, 18*b* comprises a capacitor 50 functioning as an energy storage unit or accumulator. The downhole self-propelling wireline tool 1 further comprises a machining tool 32 for performing a machining operation and a compression sub 33 comprising a load cell 34 adjacent to the machining tool. In another embodiment, the electric control unit(s) 18, 18*b* control(s) the controllable valve(s) 16, 17, 26, 27 based on the electric current and/or the electric voltage measured by the electric control unit.

In FIG. 4, the downhole self-propelling wireline tool 1 comprises a user interface 36 at a surface 37 for controlling at least part of the downhole self-propelling wireline tool. Thus, the field engineer may be informed of the current limit of the wireline/cable and through the user interface set the current limit for each motor of the tool, and the power-limiting units 31 or the current distribution unit 21 distributes the current equally between the first downhole self-propelling wireline tool 1*a* and the second downhole self-propelling wireline tool 1*b* forming the tool 1, so that both are able to drive at the same speed and therefore drive the tool string at the same speed. The first electric motor 4 may require more power than the second electric motor 22 in order to drive the tool string at the same speed, but this is possible as the first and second downhole self-propelling wireline tools 1*a*, 1*b* are electrically connected in parallel. The downhole self-propelling wireline tool string may further comprise a stroking tool, even though not shown. By having a power-limiting unit, the power can be distributed optimally as a first part of the current from the wireline to power the first electric motor and a second part of the current to power the second electric motor. This enables driving the downhole self-propelling wireline tool string having at least one pump for each drive section without the first downhole self-propelling wireline tool 1*a* and the second downhole self-propelling wireline tool 1*b* coming out of syncronisation so that one is driving faster than the other and thus functions as a "brake".

By having an electric motor and a pump for each drive section, the downhole self-propelling wireline tool string 1 is able to drive at full speed as one drive section and with double pulling force as two drive sections. The power curve, e.g. 3 kW, of a known tool string having one pump for driving two drive sections starts at the same maximum force as the power curve of the tool string having at least one pump for each drive section, but the power curve (shown in FIG. 6) of the tool string having at least one pump for each drive section extends to the point having twice the speed than that of the known tool string. Thus, at low speed the available pulling force is the same for the known tool string and the tool string of the present invention, but the downhole self-propelling wireline tool string 1 having at least one pump for each drive section is at high speed able to drive twice as fast as the known tool string having only one pump for driving two drive sections. This is due to the fact that the pumped fluid does not have to travel past one drive section to be delivered to the next, and thus no energy is wasted in the transition from one drive section to the next drive section. By having one pump for one drive section, the diameter of the fluid channels in the drive section can be made larger than when the pump has to provide fluid to more than one drive section. The overall diameter of the tool string 1 is limited by the well, and the pump is therefore often a limiting factor as more pumping capacity would require a larger diameter. By having only one drive section, the pumping force is used directly, and the fluid channel can be made larger, for which reason the limited current in the wireline is used more efficiently than in the known tool strings where several drive sections are driven by one pump.

A stroking tool is a tool providing an axial force. The stroking tool comprises an electric motor for driving a pump. The pump pumps fluid into a piston housing to move a piston acting therein. The piston is arranged on the stroker shaft. The pump may pump fluid out of the piston housing on one side and simultaneously suck fluid in on the other side of the piston.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "casing" or "well tubular metal structure" is meant any kind of pipe, tubing, tubular, liner, string, etc., used downhole in relation to oil or natural gas production.

Although the invention has been described above in connection with preferred embodiments of the invention, it will be evident to a person skilled in the art that several modifications are conceivable without departing from the invention as defined by the following claims.

The invention claimed is:

1. A downhole self-propelling wireline tool for propelling a tool forward in a well and/or for providing weight on a bit while performing an operation, comprising:

a tool body, an electric motor operating at a rotational speed and powered by a wireline, a plurality of projectable arm assemblies movably connected at a first arm end with the tool body and projectable from the tool body by means of a first fluid having a first fluid pressure, a plurality of wheels for contacting a wall of the well, each wheel comprising a hydraulic motor for rotation of the wheel to provide a self-propelling movement, each wheel being connected with a second arm end of one of the arm assemblies, a first hydraulic pump driven by the electric motor for generation of a second fluid pressure of a second fluid for driving the hydraulic motor(s) rotating the wheel(s), and a first pressure sensor measuring the second fluid pressure to provide sensor data, wherein the downhole self-propelling wireline tool further comprises a hydraulic section comprising a first controllable valve controlling the first fluid pressure based on the sensor data representing the second fluid pressure, so that the wheel is not excessively pressed outwards.

2. A downhole self-propelling wireline tool according to claim 1, wherein the first hydraulic pump generates the first fluid pressure for projection of the plurality of projectable arm assemblies.

3. A downhole self-propelling wireline tool according to claim 1, further comprising a second hydraulic pump for generation of the first fluid pressure for projection of the plurality of projectable arm assemblies.

4. A downhole self-propelling wireline tool according to claim 1, wherein the hydraulic section further comprises a second controllable valve controlling the second fluid pressure.

5. A downhole self-propelling wireline tool according to claim 1, further comprising an electric control unit for controlling the rotational speed of the electric motor.

6. A downhole self-propelling wireline tool according to claim 5, wherein the electric control unit further comprises a voltage control unit.

7. A downhole self-propelling wireline tool according to claim 5, wherein the electric control unit further comprises an electric current measuring unit.

8. A downhole self-propelling wireline tool according to claim 5, wherein the electric control unit further comprises a voltage control unit comprising an electric voltage measuring unit.

9. A downhole self-propelling wireline tool according to claim 1, further comprising a second electric motor driving a second hydraulic pump, the first electric motor driving the first hydraulic pump.

10. A downhole self-propelling wireline tool according to claim 9, wherein the second hydraulic pump generates a third fluid pressure for projection of a second plurality of projectable arm assemblies, the second hydraulic pump generating a fourth fluid pressure for driving the hydraulic motor(s) rotating a second plurality of wheels.

11. A downhole self-propelling wireline tool according to claim 10, further comprising a second hydraulic section comprising a third controllable valve controlling the third fluid pressure and a fourth controllable valve controlling the fourth fluid pressure.

12. A downhole self-propelling wireline tool according to claim 1, wherein the controllable valve(s) is/are electronically controllable by means of an electric control unit.

13. A downhole self-propelling wireline tool according to claim 1, wherein an electric control unit controls the controllable valve(s) based on electric current and/or electric voltage measured by the electric control unit.

14. A downhole self-propelling wireline tool according to claim 1, wherein the controllable valve(s) is/are (a) controllable pressure relief valve(s).

15. A downhole system comprising the downhole self-propelling wireline tool according to claim 1, the wireline and a user interface at surface for controlling at least part of the downhole self-propelling wireline tool.

* * * * *